United States Patent [19]

Brink et al.

[11] 4,022,550

[45] May 10, 1977

[54] ENCLOSED COMPRESSOR UNIT

[75] Inventors: Robert A. Brink; Richard L. Ertel; Stephen A. Thompson, all of Quincy, Ill.

[73] Assignee: Gardner-Denver Company, Dallas, Tex.

[22] Filed: Mar. 19, 1976

[21] Appl. No.: 668,550

[52] U.S. Cl. ..... 417/234; 417/312; 417/313

[51] Int. Cl.[2] ..... F04B 21/00

[58] Field of Search ..... 417/231, 234, 312, 313; 165/51

[56] References Cited

UNITED STATES PATENTS

| | | | |
|---|---|---|---|
| 2,037,830 | 4/1936 | Staley | 417/234 |
| 3,478,958 | 11/1969 | Hinck et al. | 417/234 |
| 3,588,288 | 6/1971 | Potter | 417/234 |
| 3,856,439 | 12/1974 | Moehrbach | 417/312 |

*Primary Examiner*—Carlton R. Croyle

*Assistant Examiner*—G. P. LaPointe

*Attorney, Agent, or Firm*—Michael E. Martin

[57] ABSTRACT

A portable air compressor unit includes a sound attenuating enclosure formed to have a first compartment through which cooling air flows before passing through side-by-side mounted heat exchangers for engine coolant and compressor injection liquid. Engine and compressor inlet air filters are disposed in the first compartment. An engine driven fan draws cooling air from the first compartment into a second compartment containing the engine and compressor. An engine inlet air silencer and exhaust gas muffler are also disposed in the second compartment. Heated cooling air is discharged from the second compartment into three side-by-side ducts at the end of the enclosure opposite the first compartment. Exhaust openings in the end and side walls of the enclosure provide for final exit of the cooling air from the enclosure above the level at which cooling air enters the first compartment.

11 Claims, 4 Drawing Figures

ENCLOSED COMPRESSOR UNIT

BACKGROUND OF THE INVENTION

Portable engine driven air compressor units are particularly difficult to operate at reduced sound levels required by many governmental authorities. The requirements for large flow rates of cooling air as well as engine and compressor breathing or intake air together with the vibration generated in the engine and compressor structure tend to create sound levels which are prohibited by regulations.

The attenuation of portable compressor sound emission may be accomplished by enclosures for the compressor and engine proper. However, it is desirable that compressor enclosures be as compact and lightweight as possible while also providing access to the compressor unit components for servicing and repair. Moreover, careful consideration must be given to preventing any decrease in performance and operating efficiency as well as overheating of the compressor unit due to the configuration of the enclosure.

U.S. Pat. Nos. 3,478,958 to E. C. Hinck, et al. and 3,856,439 to R. E. Moehrbach disclose prior art enclosures for portable air compressors.

SUMMARY OF THE INVENTION

The present invention provides an improved portable compressor unit having an enclosure for reducing the sound emissions from the unit proper. Sound generated by the engine and compressor and by the air flowing to and from the compressor unit is attenuated by an improved arrangement of separate compartments for inlet cooling and breathing air, for housing the compressor and engine proper, and for discharging the heated air flowing through the enclosure, respectively. By arranging the plural compartments substantially in series relationship physically and with respect to air flow through the enclosure a compact enclosure is provided which is superior in its sound attenuation characteristics without reducing the efficiency or output performance of the compressor.

The arrangement of compartments in the enclosure according to the present invention also provides for air inlet and discharge openings to be at opposite ends of the enclosure thereby minimizing the intermixing of the heated discharge air with the inlet air to the compressor unit.

Further, in accordance with the present invention there is provided an enclosed air compressor unit wherein air cooled heat exchangers for engine coolant and compressor cooling medium are disposed adjacent one another and form a portion of a common wall or partition between enclosure compartments. The reduced resistance to cooling air flow provided by the side-by-side mounting of engine and compressor heat exchangers together with large flow areas provided in all of the enclosure compartments minimizes the sound generated by the cooling air fan and by the cooling air flow itself.

The enclosure for the compressor unit of the present invention is further improved in its overall arrangement of compartments and ducts whereby a minimum amount of special sound attenuating material and structure is required in order to provide an acoustically suitable unit.

The enclosure for the compressor unit according to the present invention is further provided to be demountable from the compressor unit in easily handled sections whereby access to the compressor, engine, heat exchangers, and compressed air receiver may be achieved with minimum effort for ease of servicing and repair or replacement of these components.

The foregoing improvements as well as other advantages of the present invention will be recognized by those skilled in the art upon reading the detailed description herein together with the accompanying drawings.

DESCRIPTION OF THE PREFERRED EMBODIMENT

Figure 1:
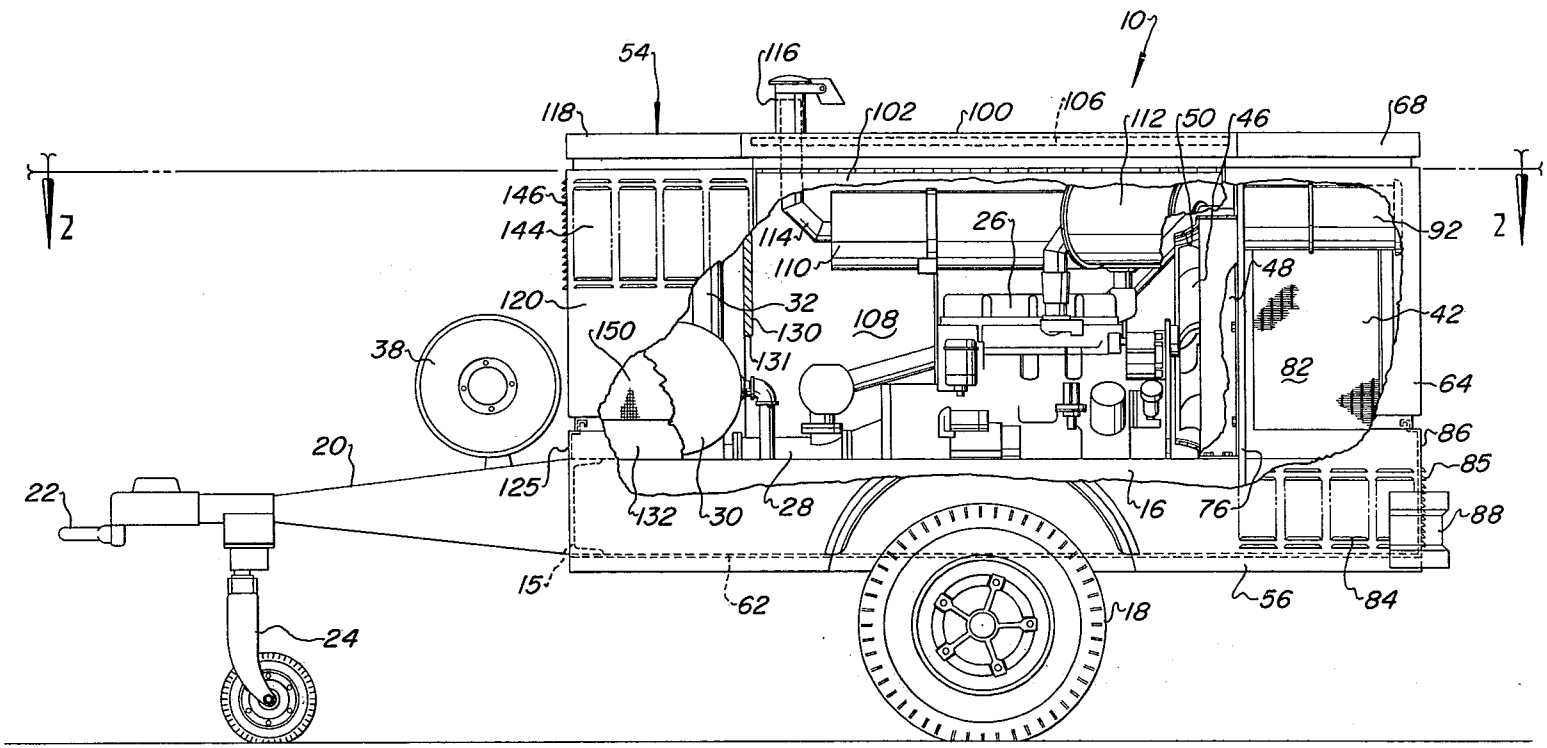
FIG. 1 is a longitudinal side elevation of an enclosed portable air compressor unit according to the present invention with portions of the enclosure broken away for purposes of illustration.
Figure 2:
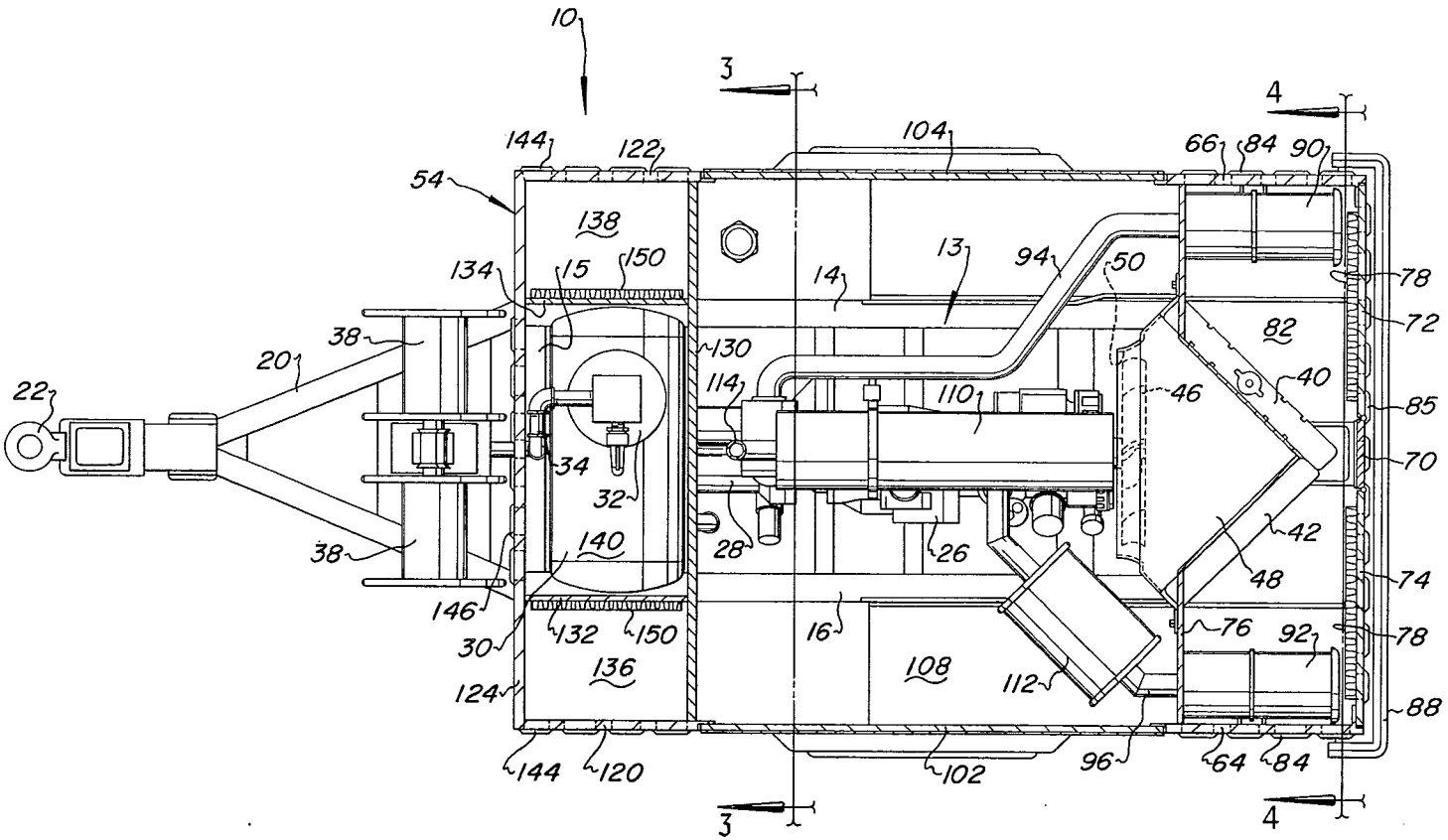
FIG. 2 is a plan view in section taken substantially from line 2—2 of FIG. 1.

Referring to the drawings and in particular to FIGS. 1 and 2 an enclosed portable air compressor unit is shown and designated by the numeral 10. The compressor unit 10 includes a frame 13 characterized by a pair of spaced apart longitudinal beams 14 and 16, FIG. 2, and supported on a wheeled undercarriage 18, FIG. 4. The frame 13 includes a drawbar 20 and a towing ring 22 for towing the compressor unit from one work site to another. A retractable landing gear 24 is provided for supporting the drawbar as illustrated.

The compressor unit 10 further includes a combustion engine 26 which is drivingly coupled to a rotary air compressor 28 of the liquid injected positive displacement type. The engine 26 and compressor 28 are supported by the frame 13 between the longitudinal beams 14 and 16. The compressor unit 10 also includes a receiver-separator tank 30 for receiving liquid laden compressed air from the compressor 28. The tank 30 is adapted to serve as a compressed air storage vessel and as a reservoir for the compressor cooling and lubricating medium such as oil. The tank 30 may also include a liquid separator element housed within a vertical tower portion 32 in a conventional manner. Final discharge of compressed air is carried through a conduit 34, and in the illustrated embodiment, to dual reeling apparatus 38 for flexible hoses, not shown.

The compressor unit 10 is further characterized by a liquid to air heat exchanger 40 of the fin and tube type mounted vertically on the compressor unit frame and disposed adjacent to a second heat exchanger 42 also mounted vertically on the frame. The frame 13 includes a somewhat V-shaped section 44, FIG. 4, for supporting the heat exchangers 40 and 42. The heat exchangers 40 and 42 are of conventional construction and are adapted, respectively, to circulate engine coolant and compressor cooling liquid therethrough. The compressor 28 of the disclosed embodiment may be of the helical screw or rotary vane type wherein the air being compressed is cooled by direct mixing of liquid with the air in the compression chambers followed by separation of the compressed air from the liquid in the tank 30 and then cooling the liquid by circulation through the heat exchanger 42 before reinjection into the compressor. The tank 30, being a reservoir for the heated compressor cooling liquid, is also a heat emitting body in itself. A compressor which cools the air being compressed directly in one or more passes of the compressed air through a heat exchanger may be substituted for the compressor 28 and a suitable heat exchanger not unlike the heat exchanger 42 may be placed adjacent to the heat exchanger 40. Moreover, the inventive concept embodied in the enclosure disclosed herein may be applied to compressors handling gases other than air.

Cooling air is drawn through the heat exchangers 40 and 42 by an engine driven fan 46 which is disposed within a shroud 48. The shroud 48 includes a tubular throat portion 50 disposed in closely spaced relationship to the radial extremities of the fan blades whereby recirculation of air drawn through the heat exchangers 40 and 42 by the fan is substantially prevented.

Figure 3:
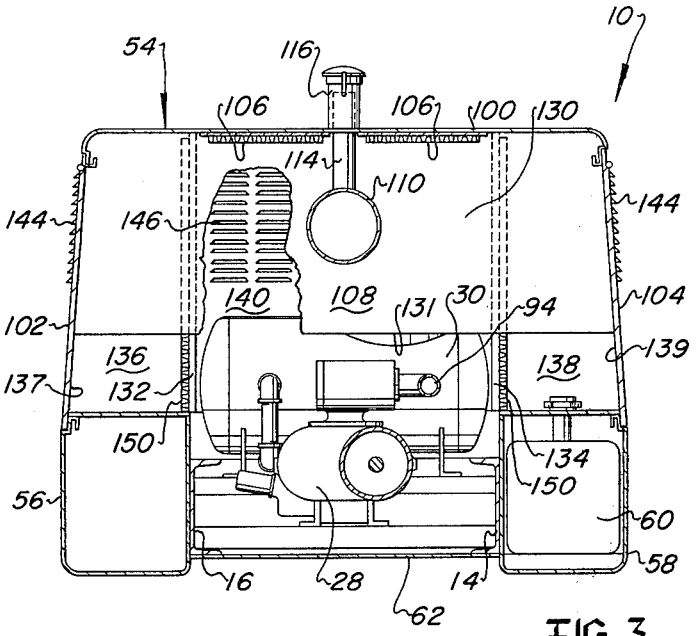
FIG. 3 is a section view taken along line 3—3 of FIG. 2.
Figure 4:
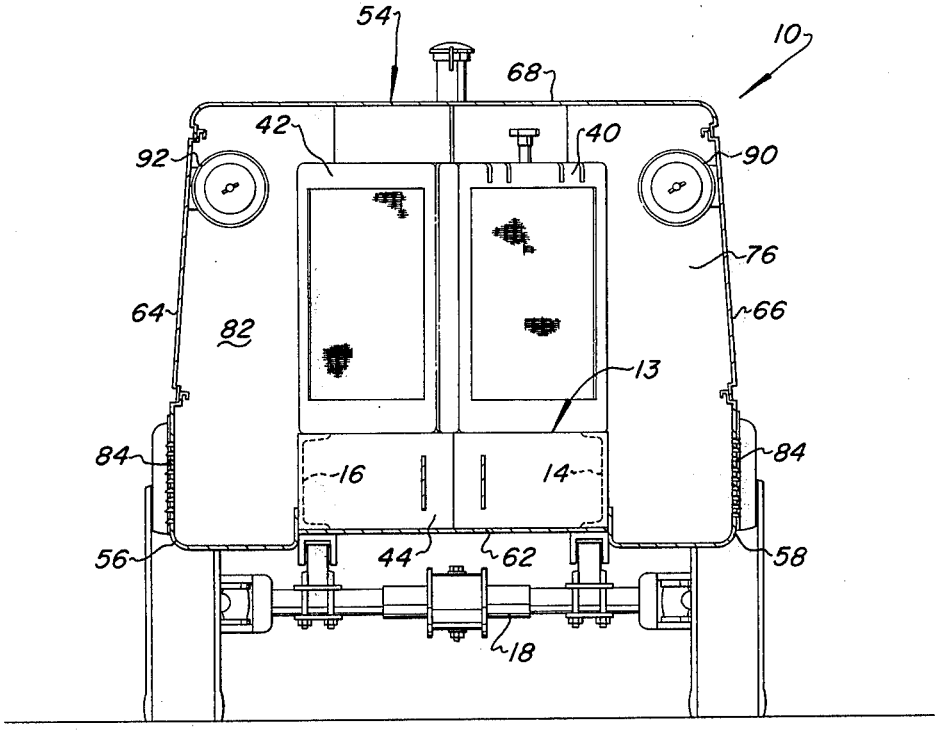
FIG. 4 is a section view taken along line 4—4 of FIG. 2.

The engine 26 and compressor 28 together with the substantial cooling and breathing air flow requirements for the compressor unit 10 are sources of audible sound. In accordance with the present invention the compressor unit 10 includes an enclosure, generally designated by numeral 54 which provides for attenuation of sound without adding undue bulk and weight to the compressor unit and without impairing the operating efficiency or compressed air output of the compressor. Referring also to FIGS. 3 and 4, the enclosure 54 comprises longitudinal fenders 56 and 58 formed of sheet metal and having hollow interiors to provide space for fuel tankage 60, as shown in FIG. 3, as well as various accessory items and tools or spare parts, not shown. The fenders 56 and 58 are fastened to the frame beams 16 and 14, respectively. A removable bottom plate 62 extends between the frame beams 14 and 16 to enclose the underside of the frame 13 as shown in FIGS. 3 and 4.

Referring to FIGS. 1, 2 and 4, the enclosure 54 is further characterized by an end part formed by vertical side walls 64 and 66, a roof portion 68 and a transverse end wall comprising a support 70 and two doors 72 and 74 mounted on the support. The side walls 64 and 66, roof portion 68, and doors 72 and 74 may be removably mounted on the fenders 56 and 58 as a unit to enclose the heat exchangers 40 and 42. A transverse wall or partition generally designated by numeral 76, extends between the side walls 64 and 66 and is spaced from the doors 72 and 74. The wall 76 also substantially surrounds the heat exchangers 40 and 42 on the top and sides thereof. Sound attenuation panels 78 are mounted on the doors 72 and 74 directly opposite the heat exchangers 40 and 42. The portion of the enclosure 54 formed by the components aforedescribed comprises a first compartment 82 into which cooling air is drawn by the fan 46. Louvers 84 formed in the outer sides of the fenders 56 and 58 and louvers 85 formed in a lower transverse wall portion 86, FIG. 1, provide for air to be admitted to the compartment 82. The louvers 84 and 85 are advantageously disposed on the lower portion of the enclosure 54 and not directly in line with the face of the heat exchangers 40 and 42 to thereby reduce emission from the compressor unit 10 of sound generated within the enclosure.

An impact guard 88 is disposed across the rear end of the compressor unit 10 and spaced from the wall portion 86 to serve also as a baffle to change the direction of inlet air flowing into the louvers 85 in the wall and to further reduce line-of-sight transmission of sound from the enclosure 54.

The compartment 82 also contains inlet air filters 90 and 92 for the compressor 28 and engine 26, respectively. The filters 90 and 92 are suitably mounted on the side walls 66 and 64, respectively, and directly below the roof portion 68. The filters 90 and 92 are connected to respective conduits 94 and 96 leading to the compressor 28 and engine 26 as shown in FIG. 2. Access to the filters 90 and 92 for cleaning and replacement may be obtained by way of the doors 72 and 74. The filters 90 and 92 are placed in the compartment 82 to reduce the sound emissions due to inlet air flowing to the compressor and engine and to reduce the possibility of imposing sustained loadings of dust laden air on the filters. Furthermore, by placing the filters 90 and 92 in the compartment 82 inlet air to the compressor and engine will not be mixed with air heated by the heat exchangers 40 and 42 or by heat emitted from the engine, compressor, and receiver tank 30.

The enclosure 54 also comprises a roof portion 100 and side wall portions formed as doors 102 and 104 which are hinged along their top edges. The roof portion 100 together with the doors 102 and 104 are adapted to be removably fastened to the remainder of the enclosure 54 for removal therefrom as a unit to gain easy access to the engine 26 and compressor 28. Sound attenuation panels 106 are mounted on the roof portion 100, as shown in FIG. 3. The roof portion 100 and side doors 102 and 104 together with the wall 76 and the heat exchangers define, in part, a second compartment 108 of the enclosure 54. The engine 26, compressor 28, an engine exhaust muffler 110, and an engine inlet air muffler 112 are disposed in the second compartment 108. An exhaust pipe 114 leads from the muffler 110 into a chimney 116 mounted on the roof portion 100 and including a suitable rain cap disposed over its discharge end. Placement of the mufflers 110 and 112 within the compartment 108 reduces the sound emitted from these elements to the exterior of the compressor unit 10. Moreover, the exhaust pipe 114 is disposed in coaxial spaced relationship with respect to the chimney 116 to prevent any vibration of the pipe from being transmitted directly to the chimney and the roof portion 100.

The enclosure 54 is further characterized by an end part comprising a roof portion 118, side walls 120 and 122, and a transverse outer end wall 124. A lower transverse wall portion 125, FIG. 1, is contiguous with the wall 124 and with a transverse frame member 15. The roof portion 118, side walls 120 and 122, and end wall 124 may be formed as separate elements suitably fastened together into a unit which is removably mounted on the fenders 56 and 58 and the lower wall portion 125 in a manner similar to the end part of the enclosure 54 defining the first compartment 82. Referring to FIGS. 1, 2, and 3 the enclosure 54 further includes a transverse partition 130 extending from the roof portion 118 downward and terminating above the fenders 56 and 58. Two spaced apart longitudinal partitions 132 and 134 are disposed on each side of the tank 30 and extend from the roof portion 118 to the top of the inside vertical walls of fenders 56 and 58, respectively, to form ducts 136, 138, and 140.

Openings 137 and 139 are formed between the respective ducts 136 and 138 and the second compartment 108. An opening is also formed between the lower edge 131 of the partition 130 and the bottom plate 62 providing for the flow of cooling air from the compartment 108 to the duct 140.

The side walls 120 and 122 include outlet openings for the cooling air flowing through the enclosure 54 which openings are in the form of louvers 144. The outer end wall 124 also includes louvers 146. In FIG. 3 the partition 130 is partially broken away to show the louvers 146 in that view. As will be noted from FIGS. 1 and 3 the louvers 144 and 146 are disposed wholly above the lower edge 131 of the partition 130. Accordingly, a line-of-sight path from the second compartment 108 to the exterior of the enclosure 54 is prevented and the ducts 136, 138, and 140 provide double bends for the flow path of air. Sound attenuation panels or linings 150 are disposed on the partitions 132 and 134 within the respective ducts 136 and 138. By placing louvers in the side walls 120 and 122 as well as the end wall 124 a relatively low pressure decrease of air flowing from the enclosure 54 is provided and the sound generated by air flow through the louvers 144 and 146 is minimized. Moreover, the directivity pattern of a particular sound pressure level is relatively short for the arrangement of louvers on the enclosure 54 for sound emanating from the inlet air louvers 84 and 85, and from the discharge air louvers 144 and 146.

In operation of the compressor unit 10 the fan 46 continuously draws ambient cooling air into the first compartment 82, through the shroud 48 into the second compartment 108, and finally discharges air from the enclosure through the ducts 136, 138 and 140. The arrangement of respective air inlet and discharge louvers on the vertical side and end walls at opposite ends of the enclosure 54 as well as the placement of the inlet louvers 84, and 85 substantially below the level of the air discharge louvers 144 and 146 reduces the possibility of recirculation of the heated air being discharged from the enclosure. The transverse wall 76 dividing the first and second compartments 82 and 108 together with the shroud 48 prevents recirculation of cooling air within the enclosure which has been drawn through the heat exchangers 40 and 42. Moreover, the placement of the receiver-reservoir tank 30 in the outlet duct 140 and the placement of the muffler 110 in the second compartment prevents transmission of heat from these respective elements to the compressor and engine inlet air.

Although the enclosure 54 is made up of a roof, side walls, fender portions, and end walls which are advantageously formed in multiple sections to provide for easy disassembly of the enclosure for access to various components of the compressor unit it will be understood that the enclosure side and end walls and roof portions may be formed in various combinations of large or small sections without departing entirely from the teaching of the present invention. Moreover, the various wall and roof portions of the enclosure 54 are conveniently fabricated of sheet metal but may be formed of other materials such as reinforced plastic. The sound attenuating panels or linings 78, 106, and 150 may be formed of glass fibre mats suitably reinforced and covered by a foraminous protective shroud.

What is claimed is:

1. A compressor unit comprising a frame, an engine mounted on said frame and drivingly connected to a gas compressor support on said frame, air cooled heat exchanger means disposed on said frame, an enclosure for said compressor unit for attenuating sound generated by said compressor unit, said enclosure being characterized by:

a roof, longitudinal side walls, transverse outer end walls, and a bottom plate for enclosing said engine, compressor, and heat exchanger means;

a first transverse partition within said enclosure defined at least in part by said heat exchanger means and dividing said enclosure into first and second compartments, said engine being disposed in said second compartment;

inlet openings in said enclosure for admitting ambient cooling air into said first compartment;

a second transverse partition extending downward from said roof and terminating above said bottom plate and spaced from said heat exchanger means to delimit said second compartment;

duct means formed in part by said second partition and said walls of said enclosure, said duct means being in communication with said second compartment by way of an opening formed between said bottom plate and said second partition;

two spaced apart longitudinal partitions extending from said second partition to one outer end wall of said enclosure and dividing said duct means into first and second side ducts and a center duct disposed between said side ducts; and, outlet openings in said enclosure for conducting cooling air from said duct means to the exterior of said enclosure; and, a fan disposed in said enclosure for causing cooling air to flow through said inlet openings into said first compartment and then through said heat exchanger means, then through said second compartment, then through said duct means, and then through said outlet openings to the exterior of said enclosure.

2. The invention set forth in claim 1 wherein:

said compressor unit includes a compressed gas receiver tank disposed in said center duct.

3. The invention set forth in claim 1 wherein:

said outlet openings include outlet openings in said one outer end wall of said enclosure communicating with said center duct, said outlet openings in said one outer end wall being disposed wholly above said openings between said second compartment and said duct means.

4. The invention set forth in claim 1 wherein:

said enclosure includes outlet openings communicating with said respective side ducts and being disposed in said enclosure wholly above said opening which provides communication between said second compartment and said duct means.

5. The invention set forth in claim 4 wherein:

said outlet openings communicating with said side ducts are disposed in the respective longitudinal side walls of said enclosure.

6. The invention set forth in claim 5 together with:

sound attenuation lining disposed on said longitudinal partitions and facing said outlet openings in said side walls.

7. The invention set forth in claim 1 wherein:

said heat exchanger means includes separate heat exchangers for engine coolant and for exchanging heat of compression of gas compressed by said compressor, said separate heat exchangers being disposed side by side on said frame to thereby increase the flow area for cooling air passing from said first compartment to said second compartment through said heat exchanger means.

8. The invention set forth in claim 3 wherein:

said inlet openings in said enclosure into said first compartment are disposed wholly below said outlet openings in said enclosure.

9. The invention set forth in claim 8 wherein:

said inlet openings are disposed on the side walls of said enclosure and on the end wall of said enclosure at the end of said enclosure opposite said one end wall.

10. The invention set forth in claim 7 together with:

sound attenuation lining disposed on an end wall of said enclosure opposite said one end wall and facing said heat exchanger means.

11. A compressor unit comprising a frame, an engine mounted on said frame and drivingly connected to an air compressor support on said frame, air cooled heat exchanger means disposed on said frame, an enclosure for said compressor unit for attenuating sound generated by said compressor unit, said enclosure being characterized by:

a roof, longitudinal side walls, transverse outer end walls, and a bottom plate for enclosing said engine, compressor, and heat exchanger means;

a first transverse partition within said enclosure defined at least in part by said heat exchanger means and dividing said enclosure into first and second compartments, said engine being disposed in said second compartment;

inlet openings in said enclosure for admitting ambient cooling air into said first compartment;

a second transverse partition spaced from said heat exchanger means and delimiting said second compartment;

duct means formed in part by said second partition and said walls of said enclosure, said duct means being in communication with said second compartment; and, outlet openings in said enclosure for conducting cooling air from said duct means to the exterior of said enclosure;

a fan disposed in said enclosure for causing cooling air to flow through said inlet openings into said first compartment and then through said heat exchanger means, then through said second compartment, then through said duct means, and then through said outlet openings to the exterior of said enclosure; and, inlet air filters disposed in said first compartment and connected to respective inlet conduits passing through said first transverse partition and leading respectively to said engine and said compressor for admitting inlet air to said engine and said compressor from said first compartment.

* * * * *